United States Patent [19]

Slavin et al.

[11] 4,284,857

[45] Aug. 18, 1981

[54] TONE GENERATOR

[75] Inventors: Michael Slavin, Troy; Irvin B. Rea, Royal Oak; George S. Todd, Washington, all of Mich.

[73] Assignee: Lectron Products, Inc., Troy, Mich.

[21] Appl. No.: 57,516

[22] Filed: Jul. 13, 1979

[51] Int. Cl.[3] ..... G10K 9/14; H04R 1/02; H04R 13/00

[52] U.S. Cl. ..... 179/115 R; 179/119 R; 340/391

[58] Field of Search ..... 179/114 R, 115 R, 119 R, 179/117; 340/391, 388

[56] References Cited

U.S. PATENT DOCUMENTS

| | | | |
|---|---|---|---|
| 1,252,056 | 1/1918 | Tannaka | 179/115 R |
| 1,665,045 | 4/1928 | Swenson | 179/115 R |
| 1,698,408 | 1/1929 | Johnson | 179/115 R |
| 2,902,668 | 9/1959 | Savit | 179/115 R X |
| 3,179,932 | 4/1965 | Gregoroff | 340/388 |
| 4,016,376 | 4/1977 | Neuhoff | 179/115 R |
| 4,160,132 | 7/1979 | Rea et al. | 179/114 R |

*Primary Examiner*—Thomas W. Brown

*Attorney, Agent, or Firm*—Harness, Dickey & Pierce

[57] ABSTRACT

An electromagnetic tone generator having a pole piece adapted to be mounted on a circuit board and to be incorporated in the circuitry thereof, an electromagnetic coil sub-assembly adapted for mounting on a coil carrying portion of the pole piece and to be separately fastened electrically and physically to the circuit board, and a sound transducer sub-assembly including a housing defining a sound cavity and a diaphragm closing the latter and held by a retainer ring detachably fastened to the housing, the sound transducer sub-assembly adapted to be tested for sound prior to assembly and for mounting on and detachable connection with the pole piece, the retainer ring being detachably fastened to the housing so that in the disassembled condition of the sound transducer sub-assembly the ring is readily removable for replacement or servicing of critical parts of the sub-assembly, and in the assembled condition of the sound transducer sub-assembly the latter is held by the pole piece spaced from the circuit board to accommodate electrical components of the latter and with the diaphragm precisely spaced from the coil carrying portion of the pole piece.

26 Claims, 5 Drawing Figures

TONE GENERATOR

BACKGROUND OF THE INVENTION

The tone generator disclosed in this application represents a further development in the tone generator construction disclosed in application Ser. No. 917,174, filed June 20, 1978, now U.S. Pat. No. 4,160,132 which also is assigned to the assignee of this application. Tone generators of the type involved here are high production items adapted and intended primarily for use in automotive vehicles, a typical application being to produce the sound that serves as a seat belt reminder to the operator. When used for this purpose, tone generators must all produce a uniform and essentially identical tone in order to satisfy customer specifications and they must all be tested for sound prior to delivery. In the predecessor construction referred to above, however, it was not possible to test the tone generator for quality of sound until after final assembly; and, if an adjustment or correction was necessary, it was a relatively difficult and time consuming job to disassemble the generator and make the necessary changes.

SUMMARY OF THE INVENTION

In the modified tone generator construction of this application, the sound transducer that produces the actual tone comprises a sub-assembly that can be tested in a suitable fixture prior to final assembly. This expedites the testing procedure and correspondingly simplifies corrections in any unit found to be defective. Also, in the modified construction of this application, the sound transducer subassembly is mounted on the pole piece in a different way which provides more room for and permits better arrangement of the diodes, resistors, capacitors, transistors and integrated circuits which are essential parts of the circuit board on which the pole piece is mounted. Moreover, the sound transducer sub-assembly and the pole piece are uniquely formed to facilitate and expedite mounting of the transducer sub-assembly on the pole piece and the pole piece in turn forms the sole support for the transducer sub-assembly whereby to maximize the space available for mounting the circuit board components. In addition, the manner in which the transducer sub-assembly is mounted on and supported by the pole piece assures precise spacing between the portion of the pole piece on which the electromagnetic coil is mounted and the diaphragm which is part of the transducer. This spacing must be held to a very close tolerance dimension in order to assure the desired tone. The electromagnetic coil itself is separately detachably fastened to the circuit board in a manner to help hold the pole piece and the sound transducer sub-assembly supported thereby in stabilized relation each with respect to the other and to the circuit board and securely on the board in a manner that prevents or at least inhibits objectionable vibrations that adversely affect the loudness and quality of sound.

DESCRIPTION OF THE DRAWINGS

In the drawing wherein for the purpose of illustration is shown a preferred embodiment of the invention.

DESCRIPTION OF THE PREFERRED EMBODIMENT

Figure 4:
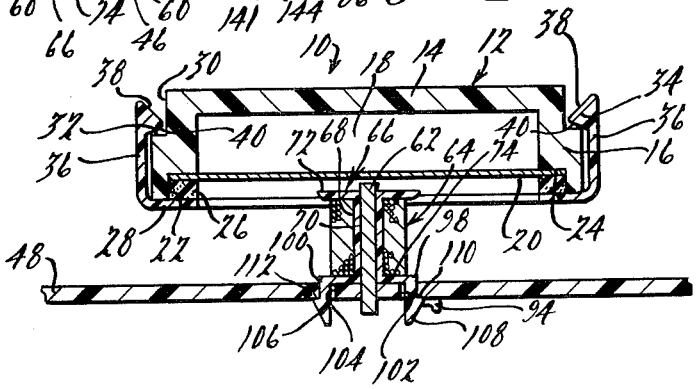
FIG. 4 is a vertical sectional view taken on the line 4—4 of FIG. 2 and particularly illustrating the manner in which the various components of the sound transducer subassembly are interrelated each to the others and joined together in a complete sub-assembly.

The sound transducer sub-assembly 10 comprises a shallow, generally cup-shaped body or casing 12 having a flat disk-shaped bottom 14 and a surrounding peripheral wall 16 which define a sound cavity 18 that is closed by a diaphragm 20 which is suitably secured thereto. As perhaps best shown in FIG. 4, the peripheral wall 16 is formed at the outer or free edge thereof with an inner annular recess 22 having an outwardly facing annular shoulder 24 on which the outer annular marginal edge portion of the diaphragm 20 seats. A flexible and resilient sealing gasket 26 of polyurethane foam material, or the like, overlays the seated marginal edge portion of the diaphragm 20 within the recess 22, and a retainer ring 28 overlays and compresses the gasket 26 to maintain the seated edge portion of the diaphragm 20 pressed firmly against the shoulder 24. At the same time, the gasket 26 permits free, unrestricted movement of the diaphragm 20 in use and permits movement of air to or from the cavity 18 to assure substantially equal pressure on opposite sides of the diaphragm at all times. If some movement of air in this manner was not provided for, pressure at opposite sides of the diaphragm 20 might vary for several reasons such as changes in temperature or altitude and this in turn would affect the character and quality of the sound produced by the transducer.

The body 12 also is formed with an outer annular bottom recess 30 that defines a rearwardly facing annular shoulder 32 which is engaged by latch elements 34 on flexible arms 36 extending rearwardly from the retaining ring 28. In the particular form of the invention here shown, there are four latch elements 34 spaced substantially equidistantly around the retainer ring 28. Tapered surfaces 38 on the latch elements 34 cause the arms 36 to flex outwardly as the retainer ring 28 is assembled on the body 12, and tapered surfaces 40 on the latch elements 34 engage over and wedge against the shoulder 32 when the latch elements 34 move into the recess 30 to hold the retainer ring 28 securely but removably attached to the body 12 and to assure pressed engagement of the retainer ring with the sealing gasket 26 and the latter compressed sufficiently to urge and hold the diaphragm 20 firmly but yieldingly against its seat 24.

The sound transducer sub-assembly 10 is a self-contained unit that can be slipped into a suitable test fixture and tested for quality of tone prior to final assembly of the tone generator. Since all of the components of the sound transducer are mass produced and randomly selected at assembly, there is always likelihood of some error occurring that would result in a faulty tone. In actual practice, such errors occur infrequently, but they do happen. Occasionally, more than one diaphragm 20 is placed in the recess 22 or a wrinkle may develop in the sealing gasket 26 due to improper placement of the gasket in the recess 22. Faults of this kind must be found and eliminated early since the problem may be difficult to locate and correct after final assembly and particularly after the tone generator has been finally assembled in an automobile, for example.

Figure 3:
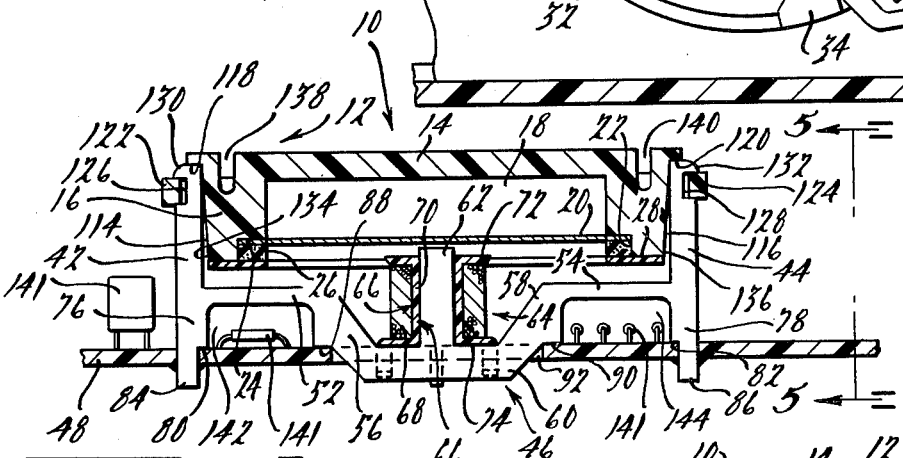
FIG. 3 is a vertical sectional view taken on the line 3—3 of FIG. 2.

The sound transducer sub-assembly 10 is mounted on and supported by spaced arms 42 and 44 of a pole piece 46 which, in turn, is mounted on and supported by a circuit board 48. The pole piece 46 is a formed, flat, plate-like metal member of generally U-shape, as shown in FIG. 3, and the two arms 42 and 44 that carry the sound transducer subassembly 10 are at opposite ends of the pole piece. More particularly, it will be observed that the pole piece 46 has horizontal end portions 52 and 54 that extend from the arms 42 and 44 substantially midway thereof and downwardly and inwardly inclined portions 56 and 58 at the inner ends of the portions 52 and 54 that are connected by a middle portion 60 which is disposed substantially below the end portions 52 and 54. Upstanding from the middle portion 60 at approximately the middle thereof is a coil mounting core member 62 which terminates below but in close proximity to the diaphragm 20 when the sound transducer sub-assembly 10 is mounted on the pole piece as shown in the drawing.

Mounted on the core member 62 is an electromagnetic coil 64 having a spool 66 and a surrounding wrapping or coil of wire 68. The spool 66 has a central tubular portion 70 and radially outwardly extending upper and lower flanges 72 and 74. The portion 70 surrounds, conforms at least generally to, and relatively closely fits the upstanding core member 62. The lower flange 74 rests on and is supported by the circuit board 48 and preferably also on the upper edge of the pole piece middle portion 60. The upper flange 72 is spaced a short distance below the top edge of the core member 62.

At assembly, the lower end portions 76 and 78 of the pole piece arms 42 seat solidly downwardly against the circuit board 48, at 80 and 82, and mounting prongs 84 and 86 on and depending from the lower arm portions 76 and 78 extend through preformed openings in the circuit board. Both of the holes that receive the mounting prongs 84 and 86 preferably are initially slightly undersize so that the mounting prongs must be pressed into the holes to assure a good stable mounting connection between the pole piece 46 and the circuit board 48. The pole piece 46 also is formed with downwardly facing shoulders 88 and 90 at approximately the junctures of the inclined portions 56 and 58 with the middle portion 60, and these two shoulders are disposed in the same horizontal plane as the lower ends 80 and 82 of the pole piece arms 42 and 44. Consequently, when the mounting prongs 84 and 86 are pressed through the circuit board to seat the lower ends 80 and 82 of the arms 42 and 44 thereon, the two shoulders 88 and 90 also seat solidly on the circuit board at opposite ends of an elongate slot 92 through which the pole piece middle portion 60 extends. It is desirable that the pole piece middle portion 60 fit the slot 92 relatively snugly but it is not necessary that this be a press fit. The mounting prongs 84 and 86 are soldered into the printed circuit on the underside of the circuit board 48 and the middle pole piece portion 60 is similarly soldered along its entire length. When the pole piece 46 is assembled on and fastened to the circuit board 48 in the manner hereinabove described, the upper edge of the pole piece middle portion 60 extends flush with or at least not above the top surface of the circuit board so that the lower spool flange 74 rests on the circuit board at opposite sides of the slot 92 in the manner hereinabove described.

Prior to assembly of the electromagnetic coil 64 on the pole piece 46, the terminal portions of the coil wire 68 are wrapped around and suitably fastened to wire retention tabs 94 and 96 on the lower spool flange 74. As perhaps best shown in FIG. 2, the flange 74 preferably is of substantially square configuration, and the two wire retention tabs 94 and 96 are disposed at and extend laterally from an edge 99 of the flange that extends parallel to the pole piece 46. When the electromagnetic coil 64 is dropped onto the upstanding core member 62, the wire retention tabs 94 and 96 are received in suitable slots (not shown) in the circuit board 48, and the tabs, with the terminal wire portions wound therearound, extend below the circuit board so that the wire ends are properly positioned and accessible for soldering into the printed circuit on the undersurface of the board. A pair of hold-down tabs 98 and 100 also are provided at opposite sides of the spool lower flange 74, one tab 98 being disposed at the edge 99 substantially midway between the two wire retention tabs 94 and 96 and the other tab 100 being disposed at substantially the middle of the opposite edge 101 so that the two hold-down tabs 98 and 100 are aligned with each other in a line extending transversely of the pole piece 46. The two hold-down tabs 98 and 100 extend through holes 102 and 104 which are preformed in the circuit board 48. The lower portions of the hold-down tabs 98 and 100 extend below the circuit board 48 and are formed with tapered edges 106 and 108 that engage the board 48 at the outer edges of the openings 102 and 104 so as to flex the tabs 98 and 100 inwardly as they are pushed through the openings, whereby shoulders 110 and 112 snap out and engage under the board 48 as the tabs are fully inserted into the openings 102 and 104. Thus, the hold-down tabs 98 and 100 interlock with the circuit board 48 on a line at right angles to the pole piece 46. This position and orientation of the hold-down tabs 98 and 100 position them in a manner to strengthen and rigidify the pole piece mounting on the circuit board 48. Of significance also is the fact that the hold-down tabs 98 and 100 not only hold the pole piece 46 securely upright on the circuit board 48 but they also act to hold the spool 66 pressed solidly downwardly against the circuit board to prevent vibration that otherwise would occur in use between the coil 64 and the pole piece or the circuit board. Such vibration, if it should occur, can seriously adversely affect the quality of the sound produced by the tone generator.

The sound transducer sub-assembly 10 can be mounted on the pole piece 46 either before or after the latter and the electromagnetic coil 64 have been mounted on the circuit board 48. However, the transducer 10 preferably is mounted afterward since it is easier to assemble and interconnect both the pole piece 46 and the electromagnetic coil 64 with the circuit board without the transducer having been previously mounted. In any event, the sound transducer 10 is mounted on the pole piece 46 by inserting the upper terminal portions of the pole piece arms 42 and 44 into longitudinal, radially outwardly opening slots 114 and 116 provided in the transducer body 12 at diametrically opposite sides thereof. The arms 42 and 44 extend upwardly into the slots 114 and 116 and seat against the upper slot ends 118 and 120; and, as the arms come into contact with the ends of the slots, straps 122 and 124 formed on the housing 12 just below the ends 118 and 120 snap into and interfit with outwardly facing recesses 126 and 128 in the arms. To this end, the outer edges of the arms 42 and 44 are beveled, as at 130 and 132, to facilitate flexure of the straps 122 and 124 outwardly as the arms approach engagement with the shoulders 118 and 120 and to assure a proper interlocking fit of the straps in the recesses 126 and 128. The arms 42 and 44 also are in pressed contact with the bottoms and both sides of the slots 114 and 116 so as to hold the sound transducer sub-assembly 10 firmly and securely and essentially free from vibration in its relation to the pole piece 46. However, in order to facilitate assembly of the sound transducer sub-assembly 10 on the pole piece 46, the portions of the slots 114 and 116 below the straps 122 and 124 are tapered slightly downwardly as at 134 and 136. The tapers 134 and 136 serve to guide the arms 42 and 44 into the slots 114 and 116 and they also provide relief directly radially outwardly from the seated peripheral marginal portion of the diaphragm 20 so as to prevent pressure exerted by the arms 42 and 44 against the bottoms of the slots 114 and 116 from being transmitted through the body 12 to the diaphragm 20 in a manner that would or might adversely affect the sound produced when the diaphragm is vibrated under the influence of the electromagnetic coil 64.

When the pole piece arms 42 and 44 are firmly seated in the slots 114 and 116 and against the slot ends 118 and 120, the upper end of the pole piece core member 62 is spaced precisely with respect to the diaphragm. This spacing or gap determines the loudness of the sound produced by the tone generator and thus significantly affects the quality of the sound. It is important that the gap be held to a close dimension, and this dimension is determined according to the present invention by the position of the slot ends 118 and 120 and by the interlocking engagement between the pole piece arms 42 and 44 and the straps 122 and 124 that hold the pole piece arms against the slot ends 118 and 120. The body 12 conveniently is injection molded of a suitable plastic resin material, and slots 138 and 140 are provided also in the housing 12 parallel to the straps 122 and 124. The slots 138 and 140 provide increased flexibility in the areas of the housing in which they are located to facilitate interlocking engagement between the straps 122 and 124 and the arm recesses 126 and 128. They also help eliminate sink marks that otherwise occur during molding due to the heavier sections defined by the relatively thick peripheral body wall 16.

By reason of the fact that the sound transducer 10 is mounted on and supported solely by the pole piece 46 and the fact that the transducer is held spaced substantially above the top surface of the circuit board 48 by the pole piece arms 42 and 44, considerable space is made available between the transducer and the circuit board in which diodes, resistors, capacitors, transistors, and perhaps other electrical components of the circuitry can be placed and arranged in the most convenient and effective way. This is of importance in laying out the circuit on the board 48 and in accommodating and properly arranging the components designated generally and collectively by the number 141 that are part of the circuitry and that accordingly must be placed on the board. The unique form of the pole piece 46 and particularly the manner in which the end portions 52 and 54 thereof are spaced above the circuit board 48 makes the spaces 142 and 144 and the subjacent areas of the board available for placement and mounting of components 141.

Figure 1:
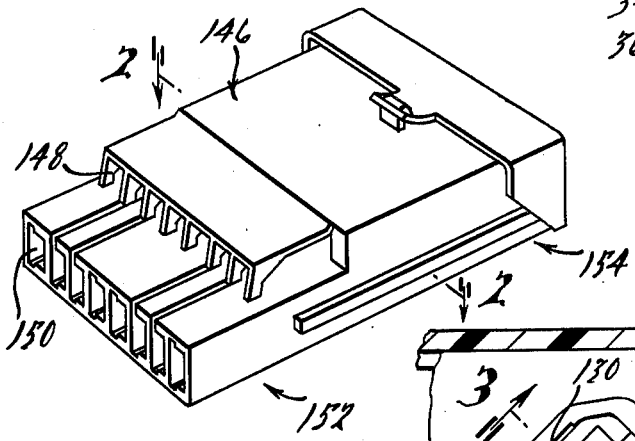
FIG. 1 is an isometric, perspective view showing a wiring connector of a conventional type in which the tone generator of this invention is adapted to be mounted.
Figure 5:
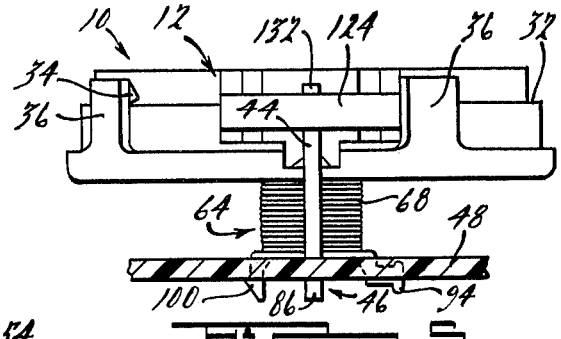
FIG. 5 is a fragmentary, vertical sectional view taken on the line 5—5 of FIG. 3.
Figure 2:
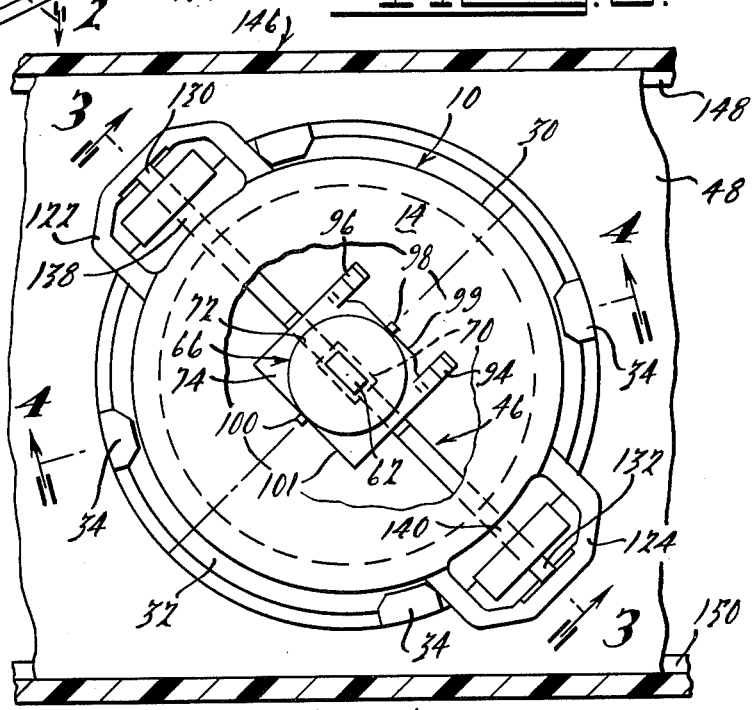
FIG. 2 is an enlarged, fragmentary, horizontal sectional view taken on the line 2—2 of FIG. 1 and showing the center portion of the transducer broken away for clearness of illustration.

The provision of adequate room for the circuitry components 141 is so critical at least in part because of the necessarily restricted dimensions of the circuit board 48. In this connection, as shown in FIG. 1, the circuit board 48 and the various elements of the sound generator carried thereby, are required to fit within a conventional wiring connector 146. The latter is generally rectangular in transverse section and is formed with longitudinal internal grooves 148 and 150 which slidably receive opposite marginal edge portions of the circuit board 48, as shown in FIG. 2. One end portion 152 of the connector 146, shown at the left in FIG. 1, is conventionally formed with double rows of openings 148 and 150 in which wire terminals are inserted to establish electrical connections with the printed circuitry on the board 48. Thus, the circuit board and the sound generator elements mounted thereon and carried thereby must be entirely accommodated in the opposite end portion 154 only of the connector 146.

We claim:

1. In a tone generator of the type having a casing provided with a sound cavity and an annular shoulder surrounding said cavity, a diaphragm closing said cavity and disposed with the peripheral marginal edge portion thereof seated on said shoulder, a retainer ring overlapping and spaced from the seated marginal edge portion of said diaphragm, and a flexible and resilient sealing gasket interposed between the overlapping portions of said diaphragm and said retainer ring, the improvement comprising means holding said retainer ring normally disposed to compress said sealing gasket against the seated marginal edge portion of said diaphragm;

a pole piece extending across said casing at the side of said diaphragm opposite said sound cavity and having a coil mounting portion extending toward said diaphragm; and means detachably fastening said pole piece to said casing with the coil mounting portion of said pole piece spaced precisely a predetermined distance from said diaphragm.

2. The invention as defined by claim 1 including a circuit board; and means fastening said pole piece to said circuit board, said pole piece forming the sole support for said casing on said board and holding the casing physically separated from said board, whereby to minimize transfer of acoustical vibration from said sound cavity to said circuit board in use and consequent distortion of the tone produced by said generator.

3. The invention as defined by claim 1 including snap fastener means on said retainer ring detachably engaged with catch means on said casing and permitting ready disassembly of said ring for remounting of said diaphragm.

4. The invention as defined by claim 1 including means separately detachably fastening said retainer ring and said pole piece to said casing, whereby said casing, diaphragm, retainer ring, and gasket comprise a self contained sub-assembly, and whereby said sub-assembly can be readily detached from said pole piece and removed as a unit for remounting of said diaphragm or other adjustments affecting the quality of the sound produced by said tone generator.

5. The invention as defined by claim 1 including a circuit board having electrical components thereon;

means fastening said pole piece to said circuit board with the same spaced sufficiently far apart to accommodate said electrical components therebetween whereby to provide for convenient placement and arrangement of said components below said casing and adjacent to said pole piece and to maximize the space on said circuit board available for said components.

6. The invention as defined by claim 5 wherein said pole piece is provided with spaced supports which are fastened to said circuit board, said supports forming the sole support for said casing on said board.

7. The invention as defined by claim 6 wherein said supports extend through said circuit board and at least certain of said supports define electrical AC ground connections at the side of said circuit board remote from said casing.

8. The invention as defined by claim 1 wherein said pole piece is provided with spaced arms, the latter being disposed in embracing relation to said casing and detachably fastened to catch means on said casing.

9. The invention as defined by claim 8 wherein said casing is provided with spaced seats which are engaged by said arms when said casing and said pole piece are assembled together and which are operative to precisely determine the gap dimension between said coil mounting portion of said pole piece and said diaphragm.

10. The invention as defined by claim 8 wherein a portion of said casing is disposed radially outwardly from the seated marginal edge of said diaphragm and is spaced from the arms of said pole piece, whereby to relieve stresses in said casing which otherwise might result from pressure by said arms exerted on the diaphragm through said casing when the latter is assembled with said pole piece.

11. The invention as defined by claim 10 wherein said casing is provided with longitudinal ways which accept said arms when said casing and said pole piece are assembled together.

12. The invention as defined by claim 10 wherein said casing is provided with longitudinal ways which accommodate said pole piece arms when said casing and said pole piece are assembled together, and wherein said ways are tapered to relieve the inner edges of said arms and to prevent said arms from exerting pressure on said diaphragm through said casing and consequent distortion of the sound produced by said tone generator.

13. In a tone generator of the type having a casing provided with a sound cavity and a diaphragm mounted for free vibratory movement across and closing said cavity, the improvement comprising a circuit board, a pole piece having a coil mounting portion, fastening means detachably interconnecting said pole piece and said casing with said coil mounting portion spaced a predetermined distance from said diaphragm, and means mounting said pole piece on said circuit board with said casing above and spaced from said board.

14. The invention as defined by claim 13 wherein said fastening means comprises spaced arms on said pole piece slidably accepted in slots in said casing at opposite sides thereof, said slots provided at the ends thereof with seating surfaces engaged by said arms, and such engagement determining the gap dimension between the coil mounting portion of said pole piece and said diaphragm.

15. The invention as defined by claim 14 wherein the bottoms of said slots extending from said seating surfaces are longitudinally tapered whereby the taper angle serves to guide said arms into engagement with said seating surfaces when said casing and said pole piece are assembled together.

16. The invention as defined by claim 14 wherein said fastening means comprises latch means on said arms and stop means on said casing bridging said slots and forming catch means interengageable with said latch means by movement of said arms into engagement with said seating surfaces.

17. The invention as defined by claim 14 wherein said fastening means comprises means on said arms and said casing operative to interlockingly interengage with each other when said arms move into engagement with said seating surfaces.

18. The invention as defined by claim 17 wherein the bottoms of said slots are tapered longitudinally of said casing, the taper angle of said slots serving multiple functions of guiding said arms into position against said seating surfaces and said fastening means simultaneously into interlocking engagement and of providing relief for said arms opposite said diaphragm, whereby to prevent said arms from exerting pressure on said diaphragm through said casing and consequent distortion of the sound produced by said tone generator.

19. A tone generator comprising a casing having a sound cavity;

a diaphragm closing said cavity;

means including a retaining ring holding the peripheral marginal portion of said diaphragm in an essentially stress-free condition;

a circuit board below said casing having electrical components thereon at the side thereof facing said casing;

a pole piece having a portion thereof spaced a predetermined distance from said diaphragm at the side thereof opposite said sound cavity;

means separately and independently detachably fastening said retainer ring and said pole piece to said casing, means permanently fastening said pole piece to said circuit board, and an electromagnetic coil on the mentioned portion of said pole piece.

20. The invention as defined by claim 19 wherein said pole piece holds said casing above and spaced from said circuit board, and wherein said pole piece provides the sole support for said casing on said circuit board, whereby the entire space between said casing and said pole piece except that occupied by the latter and said coil is available for mounting said electrical components on said circuit board.

21. A tone generator comprising a circuit board having electrical components thereon, a sound transducer sub-assembly including a diaphragm adapted to be energized to produce a sound, electromagnetic means for energizing said diaphragm, said electromagnetic means including a pole piece mounted on and fixed to said circuit board, and support means mounted on said circuit board and detachably fastened to said sound transducer subassembly holding the latter spaced from said circuit board sufficiently to accommodate at least certain of said components between it and said circuit board.

22. The invention as defined by claim 21 wherein said support means is part of said pole piece.

23. The invention as defined by claim 21 wherein said pole piece has an upstanding portion and said electromagnetic means also includes an electrical coil having a spool mounted on the upstanding portion of said pole piece, said spool extending laterally on opposite sides of said pole piece, and fastening means interconnecting the laterally extending portions of said spool and said circuit board.

24. The invention as defined by claim 23 wherein said fastening means comprises separate means on respective laterally extending portions of said spool disposed on a line extending substantially at right angles to said pole piece.

25. The invention as defined by claim 23 wherein the laterally extending portions of said spool bear on said circuit board to stabilize the mounting of said pole piece on said circuit board and to fix the position of said sound transducer sub-assembly spaced from said circuit board.

26. The invention as defined by claim 25 wherein said fastening means includes yieldable and resilient snap-action means for holding the laterally extending portions of said spool normally solidly against said circuit board to further stabilize the mounting of said pole piece on said board and to inhibit vibrations adversely affecting the quality of the tone produced by said sound transducer sub-assembly in use.

* * * * *